United States Patent [19]

Shibuya

[11] Patent Number: 4,538,976

[45] Date of Patent: Sep. 3, 1985

[54] VANE COMPRESSOR HAVING SUCTION PORT AND DISCHARGE PORT LOCATED AT THE SAME AXIAL SIDE THEREOF

[75] Inventor: Tsunenori Shibuya, Konan, Japan

[73] Assignee: Diesel Kiki Co., Ltd., Tokyo, Japan

[21] Appl. No.: 602,380

[22] Filed: Apr. 20, 1984

[30] Foreign Application Priority Data

Apr. 25, 1983 [JP] Japan ..... 58-61862[U]

[51] Int. Cl.[3] ..... F04C 18/00; F04C 29/00

[52] U.S. Cl. ..... 418/133; 418/259; 418/269

[58] Field of Search ..... 418/133, 259-261, 418/266-269

[56] References Cited

U.S. PATENT DOCUMENTS 2,099,193 11/1937 Brightwell ..... 418/260 X
3,404,634 10/1968 Connelly ..... 418/133
4,408,964 10/1983 Mochizuki et al. ..... 418/259 X
4,419,058 12/1983 Franklin, Jr. et al. ..... 418/133

FOREIGN PATENT DOCUMENTS 57-183591 11/1982 Japan ..... 418/259

*Primary Examiner*—John J. Vrablik
*Assistant Examiner*—Theodore W. Olds, III
*Attorney, Agent, or Firm*—Frishauf, Holtz, Goodman & Woodward

[57] ABSTRACT

A partition member is fitted within a casing at a location between an end wall of a pump housing accommodated within the casing and an opposed inner end face of the casing and cooperates with the one end wall to define a suction chamber therebetween. A first discharge pressure chamber is defined between an outer peripheral surface of the pump housing and an inner peripheral surface of the casing, and a second discharge pressure chamber between the above opposed inner end face of the casing and the partition member, respectively. The two discharge pressure chambers communicate with each other via passages formed through the partition member and the above end wall of the pump housing. A suction port and a discharge port are formed in the casing at the same axial side thereof, the former opening in the suction chamber in a substantially direct manner.

12 Claims, 3 Drawing Figures

VANE COMPRESSOR HAVING SUCTION PORT AND DISCHARGE PORT LOCATED AT THE SAME AXIAL SIDE THEREOF

BACKGROUND OF THE INVENTION

This invention relates to a refrigerant compressor for use in an air conditioning system for automotive vehicles, and more particularly to a vane compressor which has a suction port and a discharge port both located at the same axial side thereof.

Vane compressors, which are widely employed as refrigerant compressors in air conditioning systems for automotive vehicles, typically comprise a pump assembly mainly composed of a pump housing disposed within a casing formed by a generally cylindrical covering and a front head joined together, and a rotor and vanes accommodated within the pump housing. A suction port, through which refrigerant is introduced into the compressor, is formed in an upper portion of a front head located at a front part of the compressor and disposed to communicate with pump working chambers on suction strokes, while a discharge port, through which refrigerant is discharged from the compressor, is formed through an upper portion of the covering located at a rear part of the compressor for communication with pump working chambers on compression strokes. The compressor is adapted to be connected with the refrigerating circuit of an associated air conditioner by means of connectors mounted in the suction port and the discharge port.

However, in many automotive vehicles in which such vane compressors are to be installed, auxiliary equipments driven by the engine, such as a generator, an oil pump, and an air pump, are usually arranged at a front side of the compressor, providing difficulties in securing a sufficient space for accommodating these auxiliary equipments as well as a suction refrigerant hose or pipe connected to the suction port located at a front portion of the compressor.

Such disadvantage can be overcome by arranging the suction port together with the discharge port at a rear portion of the compressor casing, for instance. To realize this, it is desirable to also arrange the suction chamber close to the suction port at the rear portion of the compressor in order to avoid an increase in the flow resistance that the suction refrigerant undergoes, and accordingly to avoid a drop in the suction volumetric efficiency. However, if the discharge pressure chamber formed in the rear portion of the compressor is designed smaller in volume so as to provide a space for the suction chamber there, it can result in increased pulsation of discharge refrigerant being supplied into the refrigerating circuit, poor separation of lubricating oil from the discharge refrigerant, etc. On the other hand, if the volume of the discharge pressure chamber remains unchanged, it will necessitate increasing the size of the compressor.

SUMMARY OF THE INVENTION

It is the object of the invention to provide a vane compressor in which the suction port is arranged close to the discharge port at one axial side of the compressor, thereby elimitating the difficulties in providing a sufficient space for installation of auxiliary equipments as well as in laying a suction refrigerant hose or pipe at the other axial side of the compressor.

It is a further object of the invention to provide a vane compressor in which the suction chamber is arranged within a space conventionally occupied by the discharge pressure chamber without a reduction in the substantial volume of the latter, thereby making it possible to design the compressor compact in size, as well as reducing the pulsation of the discharge refrigerant and discharging noise of same.

It is another object of the invention to provide a vane compressor in which the suction refrigerant passageway between the suction port and the suction chamber has such a small value of flow resistance as ensures required suction volumetric efficiency.

It is a still further object of the invention to provide a vane compressor which is simple in construction, thereby being low in cost and as high in yield.

In a vane compressor according to the invention, a casing has a wall thereof formed therein with a suction port and a discharge port both located at the same axial side of the casing. A pump housing, which is accommodated within the casing and has at least one pump inlet and at least one pump outlet, has an end wall which has its outer peripheral surface disposed in contact with an inner peripheral surface of the casing and is disposed in axially spaced and facing relation to an inner end face of said casing to cooperate therewith to define a space therebetween. The pump housing has its outer peripheral surface radially spaced from the inner peripheral surface of the casing such that the outer peripheral surface of the pump housing other than the end wall, the inner peripheral surface of the casing and an inner end face of the end wall cooperate to define a first discharge pressure chamber therebetween.

A partition member is fitted within the casing, which has its outer peripheral surface disposed in contact with the inner peripheral surface and divides the above-mentioned space into a suction chamber defined between the end wall of the pump housing and the partition member, and a second discharge pressure chamber defined between the inner end face of the casing and the partition member.

Communication passage means communicates the first discharge pressure chamber with the second discharge pressure chamber.

The suction port opens in the inner peripheral surface of the casing and communicates with the suction chamber in a substantially direct manner.

The above and other objects, features and advantages of the invention will be more apparent from the ensuing detailed description taken in conjunction with the accompanying drawings.

DETAILED DESCRIPTION

The invention will now be described in detail with reference to the drawings illustrating an embodiment thereof.

Figure 1:
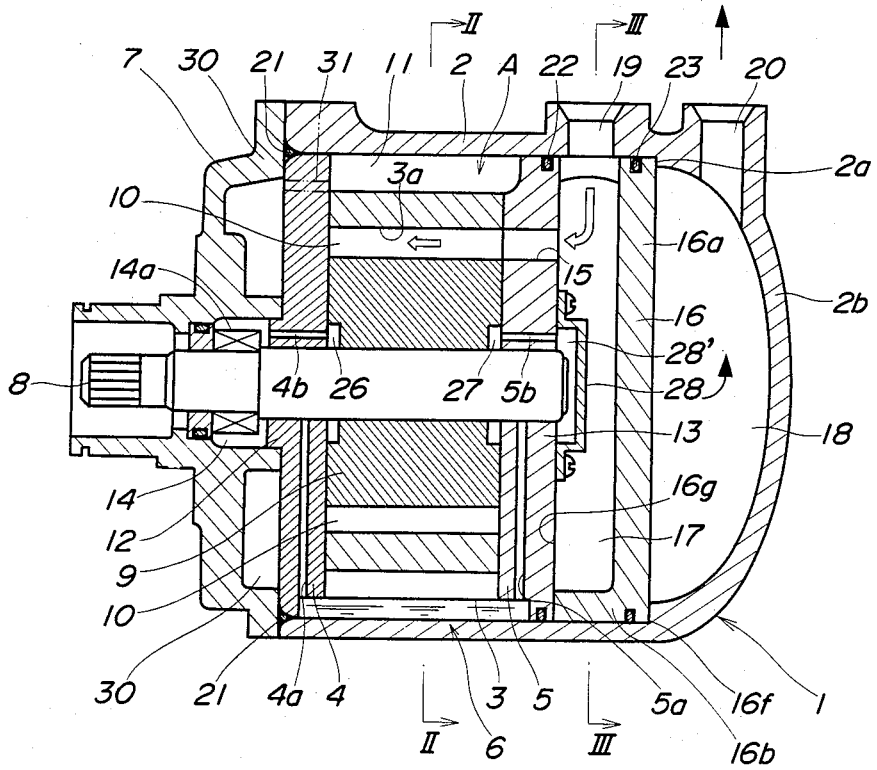
FIG. 1 is a longitudinal sectional view of a vane compressor according to an embodiment of the invention.
Figure 2:
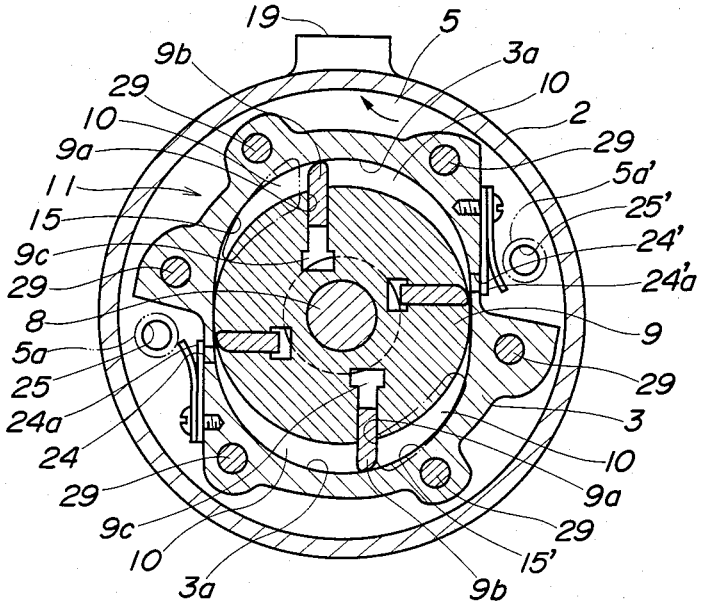
FIG. 2 is a sectional view taken along line II—II in FIG. 1.
Figure 3:
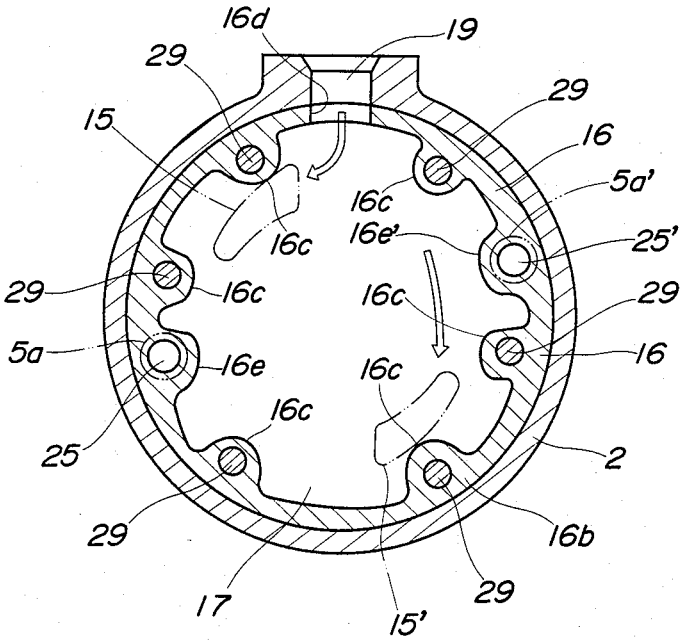
FIG. 3 is a sectional view taken along line III—III in FIG. 1.

Referring to FIGS. 1–3, there is illustrated a conventional vane compressor of the diametrically symmetrical double chamber type to which is applied the invention. A pump housing 6 is accommodated within a generally cylindrical covering 2 and is formed by a cam ring 3, and a front side block 4 and a rear side block 5 secured to opposite ends of the cam ring 3. A front head 7 is attached to the front side block 4 and the covering 2 with an annular sealing member 21 interposed therebetween, and joined to the covering 2 by means of bolts, not shown, in a manner closing an open front end of the covering 2. Thus, the front head 7 and the covering 2 cooperate to constitute the casing of the compressor.

A rotor 9 is rotatably received within the pump housing 6 and secured on a drive shaft 8. The rotor 9 cooperates with the pump housing 6 to form a pump assembly A. The rotor 9 has its outer peripheral surface formed therein with four slits 9*a* circumferentially arranged at equal intervals, in which as many plate-like vanes 9*b* are radially slidably fitted. Pump working chambers 10 are defined between the rotor 9, adjacent vanes 4*b*, an endless camming inner peripheral surface 3*a* of the cam ring 3, inner end faces of the opposite front and rear side blocks 4, 5 during rotation of the rotor 9. A first discharge pressure chamber 11 is defined in the form of an annulus between an outer peripheral surface of the cam ring 3, an opposed inner peripheral surface of the cylindrical covering 2 which is radially spaced from the outer peripheral surface of the cam ring 3, and inner end faces of the opposite front and rear side blocks 4, 5.

The drive shaft 8 is disposed through the front and rear side blocks 4, 5 while being journalled by front and bearing portions 12 and 13 formed integrally with the side blocks 4, 5, respectively, and axially extends in a gastight manner through a shaft-seal means 14*a* mounted within a sealing chamber 14 formed within the front head 7.

The outer peripheral surface of the rear side block 5 is disposed in gastight contact with the inner peripheral surface of the covering 2 along its whole circumference with an annular sealing member 22 interposed therebetween. Pump inlets 15 and 15' are axially formed through the rear side block 5 and disposed diametrically opposite to each other at such predetermined radial and circumferential locations (indicated by the two-dot chain lines in FIGS. 2 and 3) as communicate respective pump working chambers 10 on suction strokes with a suction chamber 17, hereinafter referred to.

A plate-like partition member 16 is fitted within the covering 2 at a location between a rear end face of the rear side block 5 and an end face of a rear wall portion 2*b* of the covering 2 which faces are disposed in axially spaced and facing relation to each other. The partition member 16 has a generally dished configuration and comprises a radial main portion 16*a*in the form of a disc, and an axial peripheral portion 16*b* in the form of an annulus circumferentially extending along the outer periphery of the main portion 16*a*. The main portion 16*a* has its rear end peripheral edge 16*f* fitted in an annular stepped shoulder 2*a* formed in the inner peripheral surface of the covering 2, while the peripheral portion 16*b* has its front end face 16*g* disposed in contact with the rear end face of the rear side block 5. The peripheral portion 16*b* has its inner peripheral surface formed integrally with six bosses 16*c* at circumferentially predetermined locations as shown in FIG. 3, which have axial holes formed therethrough, and the partition member 16 is fastened to the cam ring 3 together with the rear side block 5, by means of bolts 29 penetrating the respective axial holes formed through the above bosses 16*c* and axial holes formed through the rear side block 5. The peripheral portion 16*b* of the partition member 16 has its outer peripheral surface disposed in gastight contact with the inner peripheral surface of the covering along its whole circumference with an annular sealing member 23 interposed therebetween. The partition member 16 thus disposed in the covering 2 cooperates with the rear side block 5 to define a suction chamber 17 therebetween, while it cooperates with the rear wall portion 2*b* of the covering 2 to define a second discharge pressure chamber 18 therebetween.

A rear and upper wall portion of the covering 2 is formed therein with a suction port 19 and a discharge port 20 axially and closely juxtaposed to each other. The suction port 19 communicates with the suction chamber 17 through a notch 16*d* formed through an upper portion of the peripheral portion 16*b* of the partition member 16, while the discharge port 20 opens directly in the second discharge pressure chamber 18. The suction chamber 17 communicates with pump working chambers 10 on suction strokes through the pump inlets 15, 15' opening in the chamber 17, while pump working chambers 10 on compression strokes communicate with the first discharge pressure chamber 11 through pump outlets 24 and 24' formed through the cam ring 3 and discharge valves 24*a* and 24*a'* mounted on the outer wall of the cam ring 3 (FIG. 2). The first discharge pressure chamber 11 communicates with the second discharge pressure chamber 18 through discharge passages formed by communication holes 25 and 25' axially formed through two bosses 16*e* and 16*e* formed integrally on the inner peripheral surface of the peripheral portion 16*b* of the partition member 16 and through further communication holes 5*a* and 5*a'* axially formed through the rear side block 5 and aligned with the respective communication holes 25, 25'.

The lubrication system of the compressor comprises lubricating oil feeding bores 4*a* and 5*a* radially formed in the front side block 4 and the rear side block 5, respectively, with their one ends opening in lower surfaces of the respective blocks and opening in inner peripheral surfaces of the respective bearing portions 12, 13, and oil passages 4*b* and 5*b* axially penetrating the respective bearing portions 12, 13 at locations slightly radially spaced from the drive shaft 8.

The rotor 9 has its front and rear end faces formed therein with annular grooves 26 and 27 disposed around the drive shaft 8, which both communicate with four back pressure chambers 9*c* formed within the rotor 9 and communicating with the respective slits 9*a*. The oil passage 4*b* in the front side block 4 communicates the annular groove 26 in the rotor 9 with the sealing chamber 14 in the front head 7, while the oil passage 5*b* in the rear side block 5 communicates the annular groove 27 in the rotor 9 with an oil chamber 28' defined between a covering plate 28 secured to the rear side block 5 and a central part of the rear end face of the same block 5 formed with the bearing portion 13. Connectors, not shown, are mounted in the suction port 19 and the discharge port 20 for connection with the condenser and evaporator of an air conditioner, not shown, by means of hoses.

With the above described arrangement, as the drive shaft 8 rotates, usually in unison with the rotation of an engine, not shown, on an associated automotive vehicle, not shown, or the like, the rotor 9 rotates together with the drive shaft 8. This causes the vanes 9*b* to rotate while radially moving with their tips in sliding contact with the camming inner peripheral surface 3*a* of the cam ring 3 due to centrifugal force produced in the vanes per se and back pressure acted upon by the lubricating oil supplied from the first discharge pressure chamber 11 through the lubricating oil feeding bores 4*a*, 5*a* and the annular grooves 26, 27. As each pump working chamber 10 goes through its suction stroke, refrigerant is forcedly introduced into the suction chamber 17 through the suction port 19 and then drawn into the pump working chamber 10 through the pump inlet 15 or 15', as indicated by the arrows in FIGS. 1 and 3. Then, as the pump working chamber 10 goes through its compression stroke, the refrigerant therein is compressed. During the following discharge stroke of the pump working chamber 10, the compressed refrigerant is dischared into the first discharge pressure chamber 11 through the pump outlets 24 or 24' and the discharge valve 24*a* or 24'*a* forcedly opened by the refrigerant being discharged. Then, the discharge refrigerant is guided from the first discharge pressure chamber 11 to the second discharge pressure chamber 18 through the discharge passages 25, 25', 5*a*, 5*a'*, where it is temporarily stored. Thereafter, the discharge refrigerant is supplied into the refrigerating circuit, not shown, through the discharge port 20. The above cycle of suction, compression and discharge strokes is repeated to perform a refrigerant compressing action.

A lubricating action is carried out simultaneously with the above described refrigerant compressing action in the compressor. More specifically, the lubricating oil mixed in the discharge refrigerant is separated from the latter in the first discharge pressure chamber 11 and stored at the bottom of the same chamber 11. Such separation of oil from refrigerant also takes place in the second discharge pressure chamber 18, and the separated oil is guided to the bottom. of the first discharge pressure chamber 11 through guide passages, not shown, formed through the partition member 16 and the rear side block 5. Due to high internal pressure in the discharge pressure chamber 11, the lubricating oil at the bottom of the chamber is forcedly guided along the lubricating oil feeding bores 4*a*, 5*a* in the front and rear side blocks 4, 5. The oil in the bore 4*a* is then travels through a small clearance between the bearing portion 12 on the front side and the drive shaft 8, where it is divided into two axially opposite flows to lubricate sliding surfaces of the bearing portion 12 and the drive shaft 8. One of the two flows is guided into the sealing chamber 14 and then guided into the annular groove 26 on the front side through the oil passage 4*b*, while the other flow is guided into the annular groove 26 directly. Part of the lubricating oil in the annular groove 26 is guided through the back pressure chambers 9*c* in the rotor 9 into clearances between vanes 9*b* and slits 9*a* to lubricate sliding surfaces thereof, while the other part flows into the clearance between the front end face of the rotor 9 and the front side block 4 to lubricate sliding surfaces thereof.

The lubricating oil in the oil feeding bore 5*a* in the rear side block 5 flows into a small clearance between the bearing portion 13 on the rear side and the drive shaft 8, where it is divided into two axially opposite flows to lubricate sliding surfaces of the bearing portion 13 and the drive shaft 8. Then, one of the flows is delivered directly into the annular groove 27 on the rear side in the rotor 9, while the other flow is delivered into the oil chamber 28' and guided through the oil passage 5*b* into the annular groove 27. After this, the oil is guided into the back pressure chambers 9*c* to lubricate sliding surfaces of the vanes 9*b* and the slits 9*a*, or into the clearance between the rotor 9 and the rear side block 5 to lubricate sliding surfaces thereof in the same manner as the oil on the front side.

The lubricating oil is fed into the pump working chambers 10 through clearances between vanes 9*b* and slits 9*a* and through clearances between the rotor 9 and the side blocks 4, 5. In the pump working chambers 10, the lubricating oil lubricates sliding surfaces of the vanes 9*b*, the rotor 9 and the pump housing 6 and discharged into the first discharge pressure chamber 11 together with discharge refrigerant, where it is again separated from the refrigerant and stored at the bottom of the chamber 11. The above described cycle of feeding lubricating oil is repeated during operation of the compressor.

In the foregoing embodiment, the two discharge pressure chambers, i.e. the first and second discharge pressure chambers 11, 18 provide a sufficient discharge pressure space. However, besides these chambers, an annular space 30 conventionally formed within the front head 7 may be utilized as an auxiliary discharge pressure chamber. Such auxiliary chamber 30 may be communicated with the first discharge pressure chamber 11 through a communication hole 31 formed through the front side block 4 as indicated by the two-dot chain line in FIG. 1. The presence of the auxiliary chamber 30 enables securing an adequate discharge pressure space substantially as large as or larger than the total discharge pressure space in the conventional vane compressor, to compensate for a reduction in the substantial volume of the discharge pressure chamber which would otherwise be caused by the arrangement of the suction chamber 17 in a space in the rear portion of the covering which has been conventionally used as a discharge pressure chamber. Thus, the provision of such auxiliary discharge pressure chamber 30 in addition to the two discharge pressure chambers 11, 18 can result in reduced pulsation of discharge refrigerant and reduced discharging noise.

Moreover, by virtue of the arrangement of the suction port 19 in the peripheral wall of the covering 2 which opens in the inner peripheral wall of the suction chamber 17 in a substantially direct manner, suction refrigerant can only undergo small flow resistance to thereby ensure required suction volumetric efficiency.

Although in the foregoing embodiment the suction port 19 and the discharge port 20 are axially juxtaposed to each other at a rear and upper portion of the covering 2, the arrangement of the suction port and the discharge port is not limitated to the illustrated example, but the locations of these ports may be selected otherwise insofar as they are disposed to open in the suction chamber 17 and the discharge pressure chamber 18, respectively.

While in the foregoing embodiment the invention has been applied to a vane compressor of the diametrically symmetrical double chamber type, wherein the suction chamber 17 communicates with two pump inlets 15, 15' which in turn communicate with respective working chambers 10, the invention may equally be applied to a vane compressor of the single chamber type, wherein the suction chamber 17 may be disposed to communicate, on one hand, with the suction port 19, and, on the other hand, with a single pump inlet.

Obviously many modifications and variations of the present invention are possible in the light of the above teachings. It is therefore to be understood that within the scope of the appended claims the invention may be practiced otherwise than as specifically described.

What is claimed is:

1. A vane compressor comprising:

a casing having a wall having an inner peripheral surface and an inner end face, and a suction port and a discharge port formed in said wall, both said suction port and discharge port being located at the same axial side of said casing corresponding to said inner end face;

a pump housing accomodated within said casing, said pump housing having an outer peripheral surface, at least one pump inlet and at least one pump outlet, said pump housing including an end wall having an outer peripheral surface thereof disposed in contact with said inner peripheral surface of said casing along a whole circumference thereof, said end wall of said pump hosing being in axially spaced and facing relation to said inner end face of said casing and cooperating therewith to define a space therebetween, said outer peripheral surface of said pump housing being radially spaced from said inner peripheral surface of said casing, said end wall of said pump housing having an inner end face;

said outer peripheral surface of said pump housing, said inner peripheral surface of said casing, and said inner end face of said end wall of said pump housing cooperating to define a first discharge pressure chamber in the form of an annulus therebetween, said at least one pump inlet of said pump housing being formed through said end wall of said pump housing, and said at least one pump outlet of said pump housing opening in said outer peripheral surface of said pump housing;

a partition member arranged within said casing, said partition member having an outer peripheral surface thereof disposed in contact with said inner peripheral surface of said casing and dividing said space into (i) a suction chamber defined between said end wall of said pump housing and said partition member, and (ii) a second discharge pressure chamber defined between said inner end face of said casing and said partition member, said suction chamber being located axially intermediately between said first and second discharge pressure chambers, and said at least one pump inlet of said pump housing opening into said suction chamber; and communication passage means communicating said first discharge pressure chamber with said second discharge pressure chamber; said suction port of said casing opening in said inner peripheral surface of said casing and communicating with said suction chamber in a substantially direct manner.

2. A vane compressor as claimed in claim 1, wherein said partition member comprises a radially extending main portion, and a peripheral portion axially extending from said main portion to said end wall of said pump housing and extending circumferentially of said main portion, said peripheral portion having an outer peripheral surface thereof disposed in contact with said inner peripheral surface of said casing.

3. A vane compressor as claimed in claim 2, wherein said communication passage means comprises at least one through hole formed through said peripheral portion of said partition member, and at least one second through hole formed through said end wall of said pump housing and aligned with said first through hole.

4. A vane compressor as claimed in claim 2, wherein said peripheral portion of said partition member has a notch formed therethrough and aligned with said suction port, said notch communicating said suction port with said suction chamber.

5. A vane compressor as claimed in claim 2, wherein said inner peripheral surface of said casing has an annular stepped shoulder formed therein, said peripheral portion of said partition member being fitted in said annular stepped shoulder.

6. A vane compressor as claimed in claim 5, including a first annular sealing member interposed between said outer peripheral surface of said end wall of said pump housing and said inner peripheral surface of said casing, and a second annular sealing member interposed between said outer peripheral surface of said peripheral portion of said partition member and said inner peripheral surface of said casing.

7. A vane compressor as claimed in claim 2, wherein said peripheral portion of said partition member has an end face disposed in contact with said end wall of said pump housing.

8. A vane compressor as claimed in claim 1, wherein said discharge port is axially juxtaposed to said suction port.

9. a vane compressor as claimed in claim 1, wherein said pump housing comprises a cam ring having an endless camming inner peripheral surface and opposite ends, and a front side block and a rear side block secured to said opposite ends of said cam ring, said rear side block forming said end wall of said pump housing.

10. A vane compressor as claimed in claim 9, including a front head secured to said front side block, said front head having an internal space having a substantial volume, said internal space communicating with said first discharge pressure chamber through a hole formed through said front side block.

11. A vane compressor as claimed in claim 1, wherein siad partition member comprises a disc member having plain opposite end faces along a whole surface area thereof.

12. A vane compressor as claimed in claim 1, wherein said suction port opens into said suction chamber at a location axially corresponding to said suction chamber.

* * * * *